US005173578A

United States Patent [19]

Tama

[11] Patent Number: 5,173,578

[45] Date of Patent: Dec. 22, 1992

[54] PUSH BUTTON SWITCH ASSEMBLY

[75] Inventor: Naotaka Tama, Tsuruga, Japan

[73] Assignee: Matsushita Electric Industrial Co., Ltd., Osaka, Japan

[21] Appl. No.: 628,949

[22] Filed: Dec. 14, 1990

Related U.S. Application Data

[63] Continuation of Ser. No. 437,908, Nov. 13, 1989, abandoned.

[30] Foreign Application Priority Data

Nov. 18, 1988 [JP] Japan ..... 63-292758

[51] Int. Cl.[5] ..... H01H 13/30

[52] U.S. Cl. ..... 200/345; 200/250; 200/290; 200/512; 200/517; 200/341; 267/179

[58] Field of Search ..... 200/512, 513, 517, 520, 200/250, 290, 341, 342, 345; 267/179, 180

[56] References Cited

U.S. PATENT DOCUMENTS

| | | | |
|---|---|---|---|
| 2,700,788 | 2/1955 | Hennelly | 267/179 X |
| 3,272,948 | 9/1966 | Gloviak et al. | 200/345 X |
| 3,782,708 | 1/1974 | Dulude et al. | 267/179 X |
| 3,856,998 | 12/1974 | Sims, Jr. | 200/517 X |
| 4,440,992 | 4/1984 | Desmaris | 200/517 |
| 4,528,431 | 7/1985 | Coleman, III | 200/517 X |
| 4,529,848 | 7/1985 | Cherry | 200/5 A |
| 4,602,138 | 7/1986 | Berutto et al. | 200/342 X |
| 4,631,378 | 12/1986 | Nobesawa | 200/342 |
| 4,672,713 | 6/1987 | Newton et al. | 267/179 X |
| 4,733,036 | 3/1988 | Koizumi et al. | 200/517 |
| 4,755,645 | 7/1988 | Naoki et al. | 200/517 X |
| 4,831,223 | 5/1989 | Wako | 200/517 |
| 4,859,820 | 8/1989 | Gotfryd et al. | 200/517 X |

FOREIGN PATENT DOCUMENTS

| | | | |
|---|---|---|---|
| 0064615 | 11/1982 | European Pat. Off. | 200/517 |
| 617087 | 7/1935 | Fed. Rep. of Germany | 267/179 |
| 2046996 | 11/1980 | United Kingdom | 200/342 |

OTHER PUBLICATIONS

IBM Technical Disclosure Bulletin, vol. 24 No. 3 Aug. 1981 "Keyboard with Pretravelforce".

*Primary Examiner*—Ernest G. Cusick

*Attorney, Agent, or Firm*—Stevens, Davis, Miller & Mosher

[57] ABSTRACT

Disclosed is a push button switch assembly which is used in the operation panel of an electronic equipment or in the input device of an office automation apparatus. The assembly comprises a pair of upper and lower contacts, a slider body for pressing said contacts, a button for pressing said slider body, protrusions provided on respective opposing surfaces of the button and the slider body respectively, a coil spring disposed between the button and the slider body and arranged such that is end portions are forced onto and retained on the protrusions respectively, and a casing for retaining the button in a manner such that the button is vertically movable. By providing the protrusions on the back surface of the button and the bottom of the slider body respectively, the coil spring has its end portions forced, respectively, onto the protrusions to firmly hold the slider body in place. Thus, the components involved become easy to be incorporated into the assembly.

3 Claims, 6 Drawing Sheets

PUSH BUTTON SWITCH ASSEMBLY

This application is a continuation of application Ser. No. 437,908, filed Nov. 13, 1989, abandoned.

BACKGROUND OF THE INVENTION

1. Field of the Invention

The present invention relates to a push button switch assembly which is suitable for use in operation panels of electronic equipments, input devices of OA (office automation) apparatus, etc.

2. Statement of the Related Art

A conventional push button switch assembly will first be described below with reference to FIGS. 9 and 10. FIG. 9 is a top view of a keyboard in part used for the push button switch assembly. FIG. 10 is a side sectional view of the push button switch assembly corresponding to a portion A shown in FIG. 9.

Referring now to FIG. 10, a reference numeral 5 denotes a casing in which a button 4 is vertically movably mounted. A push button switch assembly which will be described hereinbelow is provided below this button 4. A reference numeral la denotes a flexible connector which is coupled to a substrate 1 as hereinbelow described and which is adapted for transmitting the state of switching of the push button switch assembly to a main body of an equipment involved.

Next, the conventional push button switch assembly which corresponds to a subject matter of the present invention will be described. The substrate 1 has a pair of stationary contacts 1*a* and 1*b*. On this substrate 1 there is disposed a cup-shaped rubber contact 2. The casing 5, which has the button 4 mounted in its cylindrical slide hole 3, is configured such that the rubber contact 2 and the slide hole 3 are in alignment with each other. The button 4 has an indicating section 4*a* on its upper surface. The button 4 further has claw portions 6 engageable with apertures in the casing 5 as well as a slide portion 7 slidable on the inner wall surface of the slide hole 3. A cylindrical slider body 8, which is slidable on the inner wall surface of the slide portion 7, is mounted inside of the same 7. Within this slider body 8 there is mounted a coil spring 9 for causing the slider body 8 to be pressed against the rubber contact 2.

In the above-described prior art push button switch assembly, when assembled, the casing 5 is first engaged with the button 4 and then the coil spring 9 and the slider body 8 are sequentially inserted into the button 4 and finally the substrate having the rubber contact 2 and the stationary contacts 1*a*, 1*b* is mounted on the casing 5.

The operation of the above-described prior art push button assembly will now be described. As the button 4 is depressed, the coil spring 9 is compressed. This compressing force is transmitted to the rubber contact 2 through the slider body 8 until the conduction between the contacts 1*a* and 1*b* becomes effective by means of the rubber contact 2. When the button 4 is further depressed, the button 4 is moved until a flat surface portion 10 of the back surface thereof abuts against the top surface portion 11 of the cylindical slide hole 3, thus being moved by a distance corresponding to a full stroke. During this movement, the slider body 8, which acts to apply the force to the rubber contact 2, performs its vertical parallel movement. In this way, in the prior art technique wherein the slider body 8 is provided inside of the button 4, a more stable pressing force is applied to the rubber contact 2 as compared with a case where the rubber contact 2 is directly pressed by the coil spring 9.

SUMMARY OF THE INVENTION

In the above-described prior art push button switch assembly, however, since the slider body 8 and the coil spring 9 are not fixed to each other, there arises, for example, an inconvenience that one of them is disengaged from the other during assembling them. This makes it difficult to assemble the push button switch assembly.

The present invention has been made in view of the above-described problems inherent in the prior art and an object thereof is to provide a push button switch assembly in which protrusions are provided on the back surface of the button and the bottom of the slider body, respectively, and the ends of the coil spring are brought into engagement with such protrusions, respectively, and in which provision of such protrusions enables engagement of the coil spring therewith to hold the slider body in place, thus to facilitate the assembling of the push button switch assembly.

DESCRIPTION OF THE PREFERRED EMBODIMENTS

Figure 1:
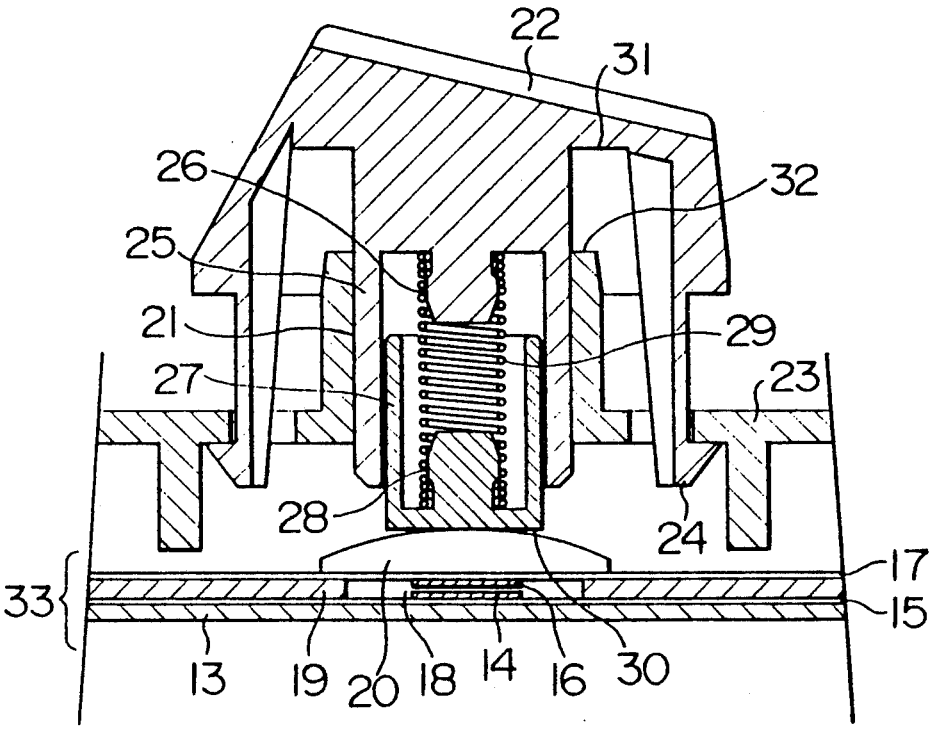
FIG. 1 is a side sectional view of a push button switch assembly in accordance with an embodiment of the present invention.
Figure 2:
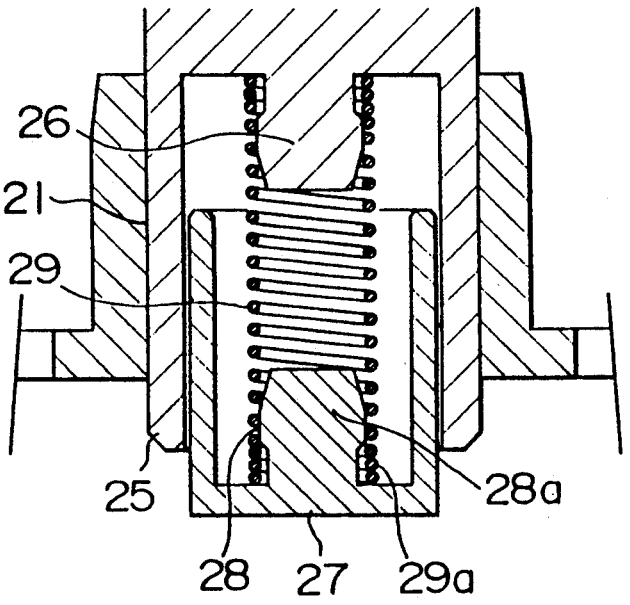
FIG. 2 is a sectional view of an essential portion thereof.

A push button switch assembly according to an embodiment of the present invention will hereinafter be described with reference to FIGS. 1 and 2. FIG. 1 is a side sectional view of the push button switch assembly while FIG. 2 is a sectional view of an essential portion thereof. Referring to FIGS. 1 and 2, a reference numeral 13 designates a rigid substrate, on which a lower insulation film 15 having a stationary contact 14 is disposed. An upper insulation film 17 having a movable contact 16 is disposed over a lower insulation film 15 in a state wherein a spacer 19 formed with an opening 18 is interposed therebetween and that the movable contact 16 opposes the stationary contact 14. On the upper insulation film 17 there is arranged a pressing section 20 such as a diaphragm formed of a metallic thin plate, the pressing section 20 causing the conduction between the contacts 14 and 16 to be effective. Thus, a switch unit 33 is formed. The push button switch assembly includes a casing 23 which has a button 22 mounted in its slide hole 21. This casing is disposed so that the slide hole 21 may be brought into alignment with the switch unit 33. The button 22 includes claw portions 24 engageable with apertures in the casing 23, a slide portion 25 slidable on the inner wall surface of the slide hole 21. A substantially cylindrical protrusion 26 is provided within the slide portion 25. A slider body 27 slidable on the inner wall surface of the slide portion 25 is disposed inside of the same. A substantially cylindrical protrusion 28 is provided on the bottom of this slider body 27, and the ends of a coil spring 29 are forced onto the protrusions 28 and 26, respectively. Thus, the slider body 27 is fixed to the button 22 through the coil spring 29. Further, a flat surface portion 30 of the slider body 27 at the forward end thereof is caused to make contact with the upper surface of the pressing portion 20, thereby holding the button 22 in place.

The above-described push button switch assembly is assembled in such a manner that the slider body 27 is incorporated beforehand into the button 22 by way of the coil spring 29 and then the button 22 is mounted to the casing 23 which is then mounted thereto with the switch unit 33. Or alternatively, a button unit is first formed by incorporating the slider body 27 beforehand into the button 22 by way of the coil spring 29, and this button unit is mounted to the casing 23 having the switch unit 33 mounted thereon, thus assembling the push button switch assembly. Further, recesses are respectively formed at respective end portions of the protrusions 26 inside of the slide portion 25 and the protrusion 28 at the bottom of the slider body 27, and the end portions of the coil spring 29 are retained in those recesses, respectively.

The operation of the above-described embodiment will hereinafter be described. As the button 22 is depressed, the coil spring 29 is compressed. This compressing force is transmitted to the upper insulation film 17 through the slider body 27 and the pressing section 20. A further depression of the button 22 eventually causes the movable contact 16 to make contact with the stationary contact 14, resulting in that the switch portion becomes conductive. A yet further depression of the button 22 causes the button 22 to be moved until the flat portion 31 or back surface thereof abuts against the top 32 of the slide hole 21. Thus, the button 22 is moved by a distance corresponding to its full stroke. During this movement, the slider body 27 which applies the force to the pressing section 20 makes its vertical parallel movement while it being guided along the inner wall surface of the slide portion 25.

As described above, according to this embodiment, the coil spring 29 can be forced onto and engaged with the protrusion 26 provided inside of the slide portion 25 and the protrusion 28 provided on the bottom of the slider body 27, thereby fixing the slider body 27 in place. This is very advantageous for assembling the push button switch assembly. In addition, since the slider body 27 can be retained on the button 22 through the coil spring 29, there is no need to provide any retainer means with respect either to the button 22 of to the slider body 27. This enables reduction in cost of the mold.

Figure 3:
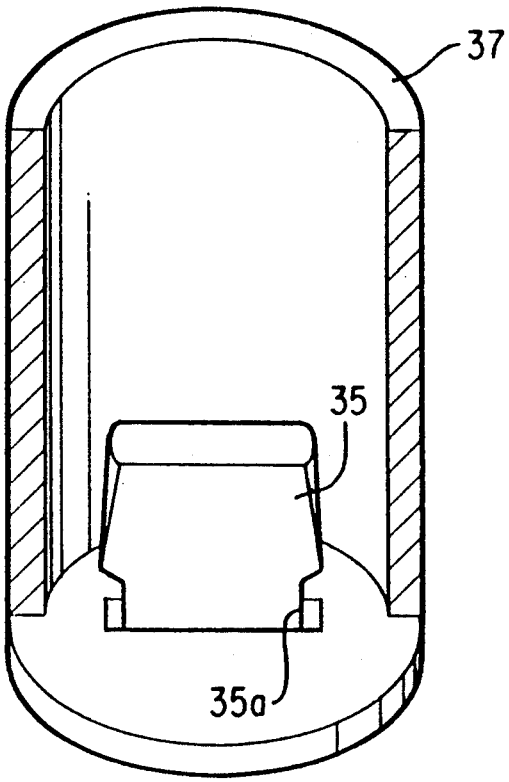
FIG. 3 is a perspective view illustrating the state of a protrusion of the slider body constituting an essential portion of a push button switch assembly in accordance with a second embodiment of the present invention.
Figure 4:
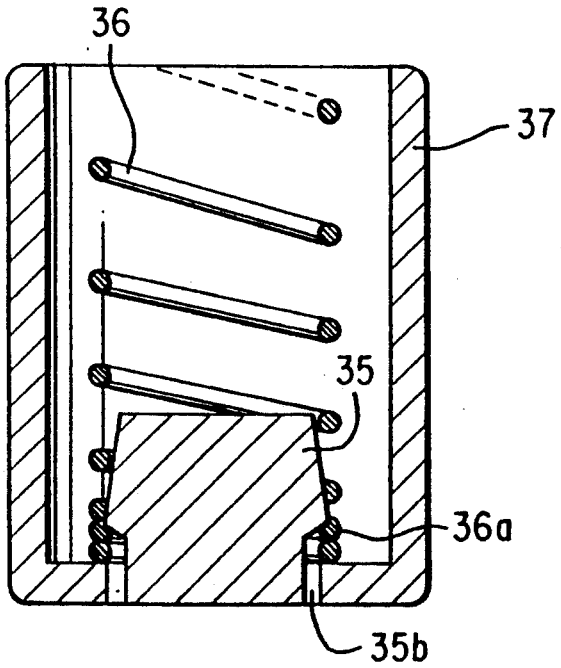
FIG. 4 is a sectional view illustrating a state of engagement of a coil spring with the slider body of FIG. 3.

FIGS. 3 and 4 are views illustrating essential portions, respectively, of a push button switch assembly in accordance with a second embodiment of the present invention. FIG. 3 is a perspective view illustrating the state of a protrusion of the slider body while FIG. 4 is a sectional view illustrating the state of engagement between the coil spring and the slider body. Referring now to FIGS. 3 and 4, a reference numeral 35 designates a flat-plate like protrusion provided on the bottom of the slider body 37. By making the protrusion into the form of a flat plate, it is possible to facilitate forced insertion and incorporation of the coil spring 36. Simultaneously, since an end portion **36*a* of the coil spring 36 is disposed in recesses 35*a* of the protrusion, the end portion 36*a* coheres to the bottom of the slider body 37, thus providing a stable feeling of operation. Further, if through-holes 35*b* are formed in the bottom of the slider body which is under the recesses 35*a* for the purpose of providing the recesses 35*a* at the foot of the protrusion 35, it is possible to simplify the mold structure and in addition to prevent the coil spring 36** from coming off from the protrusion. This offers an easy assembling of the push button switch assembly as well as an inexpensive manufacture of the same. It is to be noted that the structure of this second embodiment is the same as that of the first embodiment except for the essential portions which have been referred to as above.

Figure 5:
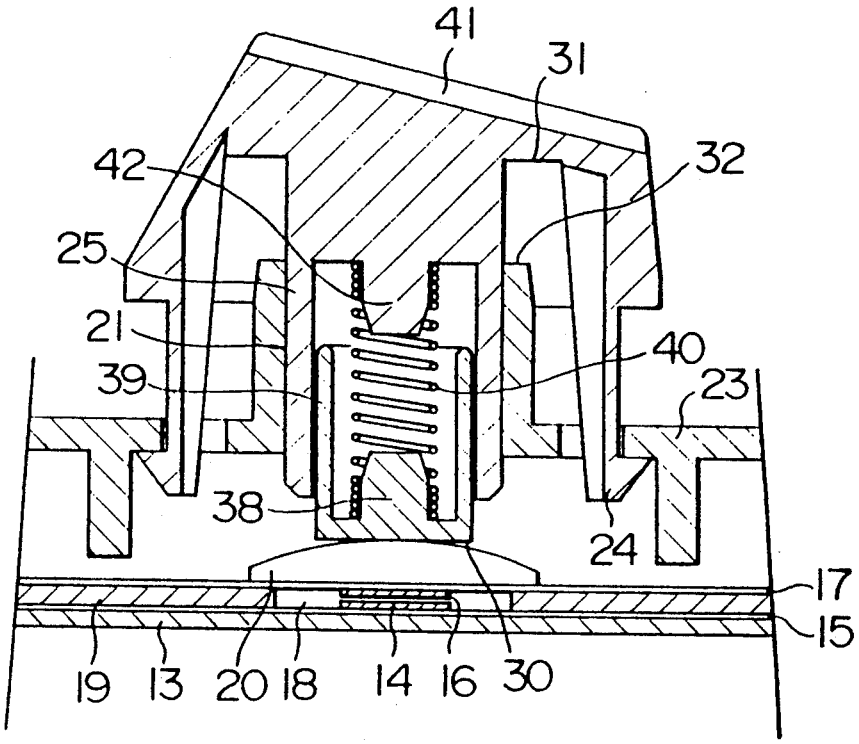
FIG. 5 is a side sectional view of a push button switch assembly in accordance with a third embodiment of the present invention.
Figure 6:
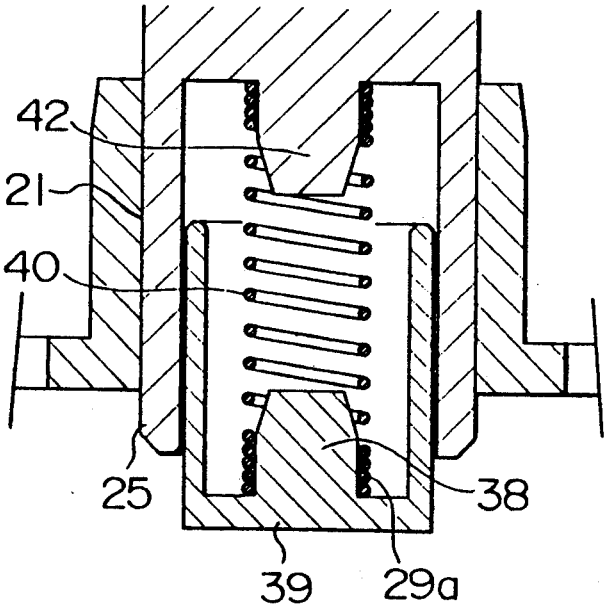
FIG. 6 is a sectional view of an essential portion thereof.

FIGS. 5 and 6 show a push button switch assembly in accordance with a third embodiment of the present invention. FIG. 5 is a side view of an essential portion thereof. The like portions as those shown in FIGS. 1 and 2 are denoted by like reference numerals, respectively, and description thereof is omitted. A reference numeral 38 designates a protrusion which is provided with respect to a slider body 39. A coil spring 40 has its one end portion forced onto and retained on the protrusion 38. The other end portion of the coil spring 40 is forced onto and retained on a protrusion 42 provided on the back surface of a button 41.

Figure 7:
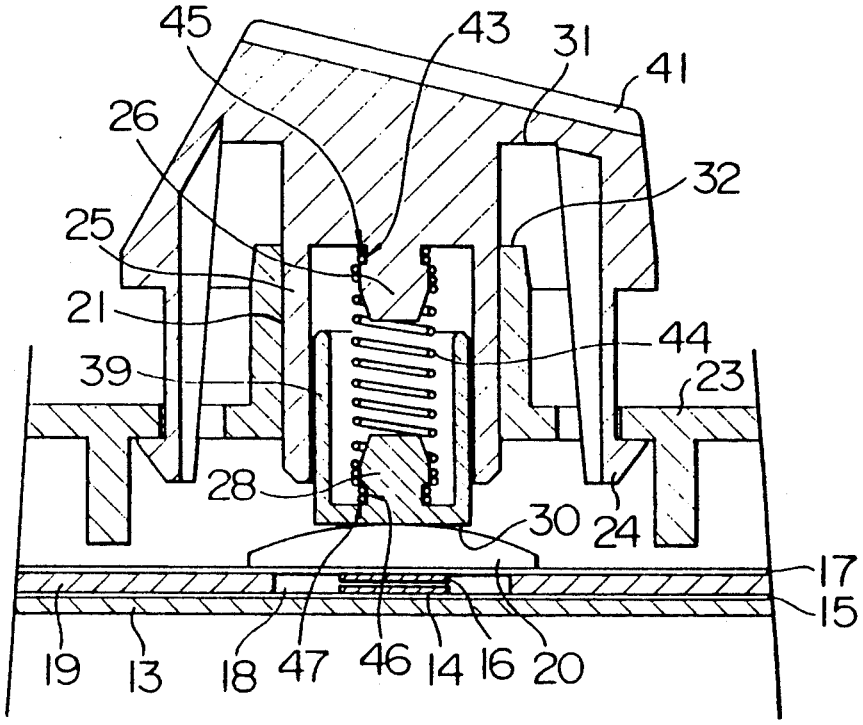
FIG. 7 is a side sectional view of a push button switch assembly in accordance with a fourth embodiment of the present invention.
Figure 8:
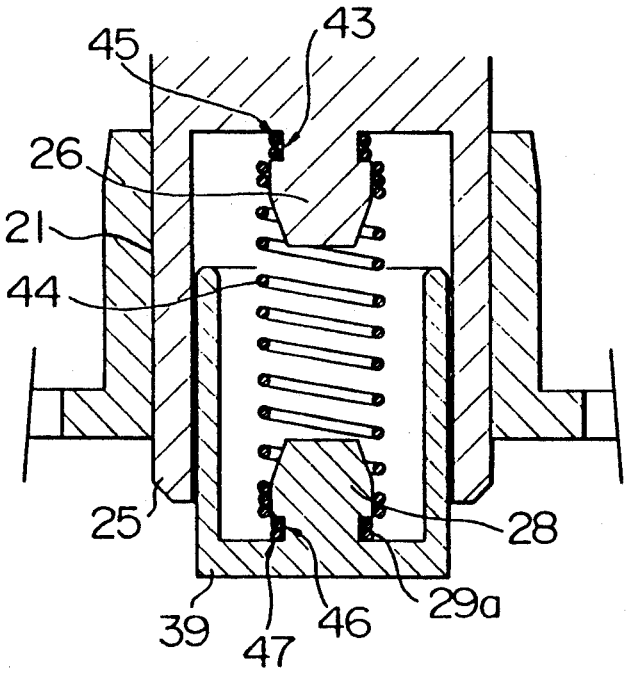
FIG. 8 is a sectional view of an essential portion thereof.
Figure 9:
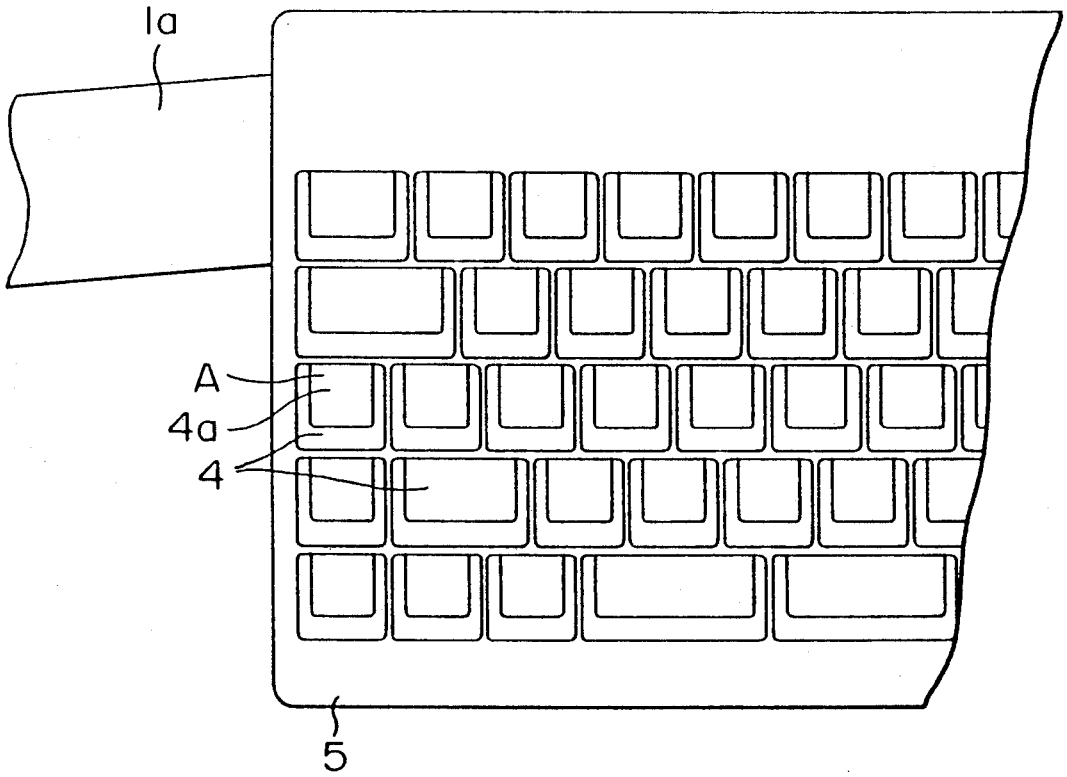
FIG. 9 (PRIOR ART)
FIG. 9 is a view partly showing the upper surface of a keyboard of a push button switch assembly according to the prior art.
Figure 10:
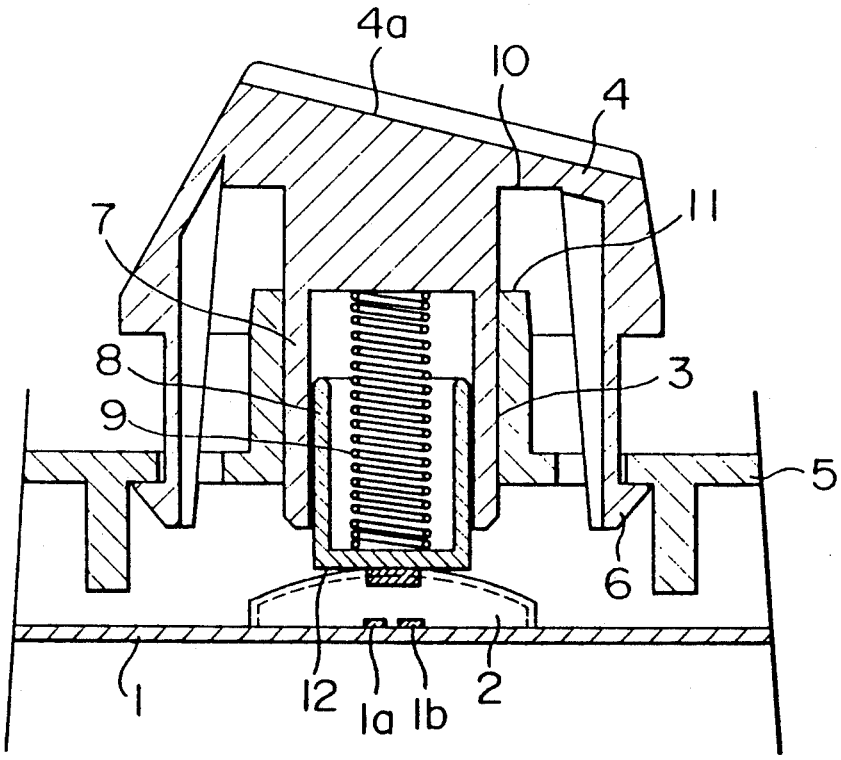
FIG. 10 (PRIOR ART)
FIG. 10 is a side sectional view of a conventional push button switch assembly according to the prior art.

FIGS. 7 and 8 show a push button switch assembly in accordance with a fourth embodiment of the present invention. FIG. 7 is a side sectional view thereof while FIG. 8 is a sectional view of an essential portion thereof. A reference numeral 43 denotes a recess which is formed in the protrusion 26, and a reference numeral 46 a recess which is formed in the protrusion 28. Reference numerals 45 and 47 denote decreased diameter end portions, respectively, of a coil spring 44. The coil spring 44 is retained on the protrusions through fitting of the decreased diameter end portion 45 into the recess 43 and through fitting of the decreased diameter end portion 47 into the recess 46.

As will be apparent from the foregoing embodiments, the present invention brings about the following advantages.

(1) Since a coil spring is engaged with and retained on a protrusion on the back surface of the button and a protrusion on the bottom of a slider body, there is no need to provide any engaging or retaining means for engagement or retention between the button and the slider body. This enables simplification of the structure and therefore reduction in cost of the mold involved; and, (2) Since the button, slider body and coil spring are assembled beforehand in the form of an assembling preparation, such an advantage is obtained that the push button switch assembly, or a complete product, becomes easy to be assembled.

What is claimed is:

1. A push button switch assembly comprising:

a pair of upper and lower contacts;

a cylindrical slider body having an inner bottom surface for pressing said contacts;

a button having an inner bottom surface facing said inner bottom surface of said slider body, for pressing said slider body, said button having a guide means for guiding said slider body, projections provided, respectively, on said inner bottom surface of said button and said inner bottom surface of said slider body, each of said projections having a side surface formed therein with a recess; and a coil spring disposed between said inner bottom surface of said button and said inner bottom surface of said slider body and having both end parts thereof fitted, respectively, on said projections and locked respectively by said recesses;

a casing holding said button so as to enable said button to move vertically, and housing at least said contacts therein; wherein each of said projections is planar, having said side surface thereof formed with recesses, wherein said inner bottom surface of said slider body has further formed therein access through-holes at positions below said recesses.

2. A push button switch assembly as set forth in claim 1, wherein each of both end parts of said coil spring is formed of densely wound coil wire which is locked in said recesses.

3. A push button switch assembly comprising:

a pair of upper and lower contacts;

a cylindrical slider body having an inner bottom surface, for pressing said contacts;

a button having an inner bottom surface facing said inner bottom surface of said slider body, for pressing said slider body, said button having a guide means for guiding said slider body;

planar projections provided, respectively, on said inner surface of said slider body and said inner surface of said button, and each projection being provided with recesses in its side surfaces, said inner bottom surface of said slider body being formed therein with access through-holes at positions below said recesses;

a coil spring disposed between said inner bottom surface of said button and said inner surface of said slider body and having both end parts thereof fitted on said projections and locked in said recesses; and a casing holding said button so as to enable said button to move vertically, and housing at least said contacts therein.

* * * * *